US005302971A

United States Patent [19]

Ohba et al.

[11] Patent Number: 5,302,971

[45] Date of Patent: Apr. 12, 1994

[54] LIQUID DISCHARGE RECORDING APPARATUS AND METHOD FOR MAINTAINING PROPER INK VISCOSITY BY DEACTIVATING HEATING DURING CAPPING AND FOR PREVENTING OVERHEATING BY HAVING PLURAL HEATING MODES

[75] Inventors: Takashi Ohba, Atsugi; Hiroshi Iida; Haruyuki Matsumoto, both of Tokyo, all of Japan

[73] Assignee: Canon Kabushiki Kaisha, Tokyo, Japan

[21] Appl. No.: 947,951

[22] Filed: Sep. 21, 1992

Related U.S. Application Data

[63] Continuation of Ser. No. 640,582, Jan. 14, 1991, abandoned, which is a continuation of Ser. No. 406,814, Sep. 12, 1989, abandoned, which is a continuation of Ser. No. 132,692, Dec. 14, 1987, abandoned, which is a continuation of Ser. No. 009,108, Jan. 29, 1987, abandoned, which is a continuation of Ser. No. 813,485, Dec. 26, 1985, abandoned.

[30] Foreign Application Priority Data

Dec. 28, 1984 [JP] Japan ..... 59-280716
Dec. 28, 1984 [JP] Japan ..... 59-280717
Dec. 28, 1984 [JP] Japan ..... 59-280718

[51] Int. Cl.[5] ..... B41J 2/165; B41J 2/05

[52] U.S. Cl. ..... 346/1.1; 346/140 R

[58] Field of Search ..... 346/1.1, 140

[56] References Cited

U.S. PATENT DOCUMENTS

| | | | |
|---|---|---|---|
| 3,790,703 | 2/1974 | Carley | 346/140 X |
| 3,914,772 | 10/1975 | Kashio | 346/75 |
| 3,971,039 | 7/1976 | Takano et al. . | |
| 3,999,190 | 12/1976 | Brown | 346/140 |
| 4,007,684 | 2/1977 | Takano | 346/140 X |
| 4,045,802 | 8/1977 | Fukazawa et al. | 346/140 R |
| 4,158,847 | 6/1979 | Heinzl | 346/140 |
| 4,176,363 | 11/1979 | Kasahara | 346/140 |
| 4,250,512 | 2/1981 | Kattner | 346/140 |
| 4,275,402 | 6/1981 | Kern | 346/140 |
| 4,296,421 | 10/1981 | Hara | 346/140 |
| 4,321,607 | 3/1982 | Heibein et al. . | |
| 4,352,114 | 9/1982 | Kyogoku | 346/140 |
| 4,369,454 | 1/1983 | Kyogoku | 346/140 |
| 4,376,945 | 3/1983 | Hara | 346/140 |
| 4,380,771 | 4/1983 | Takatori | 346/140 |
| 4,388,630 | 6/1983 | Osaki et al. . | |
| 4,450,454 | 5/1984 | Koto | 346/140 |
| 4,459,469 | 7/1984 | Ishima | 219/497 |
| 4,490,728 | 12/1984 | Vaugat | 346/140 X |
| 4,492,966 | 1/1985 | Seki | 346/140 X |
| 4,544,931 | 10/1985 | Watanabe | 346/140 |
| 4,609,625 | 9/1986 | Nozu | 346/140 X |
| 4,660,056 | 4/1987 | Yokoi | 346/140 |
| 4,692,777 | 9/1987 | Hasumi | 346/140 |
| 4,712,172 | 12/1987 | Kiyohara et al. . | |
| 4,719,472 | 1/1988 | Arakawa | 346/140 |

FOREIGN PATENT DOCUMENTS

| | | | |
|---|---|---|---|
| 2659398 | 7/1978 | Fed. Rep. of Germany . | |
| 2746617 | 4/1979 | Fed. Rep. of Germany . | |
| 2943164 | 5/1980 | Fed. Rep. of Germany . | |
| 2945658 | 5/1980 | Fed. Rep. of Germany . | |
| 3012930 | 10/1980 | Fed. Rep. of Germany . | |
| 3518823 | 11/1985 | Fed. Rep. of Germany . | |
| 54-24658 | 8/1979 | Japan . | |
| 54-246588 | 8/1979 | Japan . | |
| 159465A | 12/1985 | United Kingdom | B41J3 2 |

*Primary Examiner*—Joseph W. Hartary

*Attorney, Agent, or Firm*—Fitzpatrick, Cella, Harper & Scinto

[57] ABSTRACT

A liquid-discharge recording apparatus includes a recording head, an emission signal generator, and a heating signal generator. The recording head includes electrothermal energy converting elements for generating energy used to emit liquid in response to an emission signal from an emission signal generated by the emission signal generator. The heating signal generator generates an electrical signal applied to the electrothermal energy converting elements of sufficient level for heating the liquid, without discharging, during a first heating mode when power is supplied to the apparatus and for generating an electrical signal during a second heating mode, subsequent to the first heating mode, when recording begins after an interruption in power supply. In addition, a controller is provided for controlling a heater such that the heater is deactivated when the discharge opening of the recording head is capped. A liquid-discharge recording method is applied to the liquid-discharge recording apparatus.

12 Claims, 5 Drawing Sheets

LIQUID DISCHARGE RECORDING APPARATUS AND METHOD FOR MAINTAINING PROPER INK VISCOSITY BY DEACTIVATING HEATING DURING CAPPING AND FOR PREVENTING OVERHEATING BY HAVING PLURAL HEATING MODES

This application is a continuation, of application Ser. No. 07/640,582 filed Jan. 14, 1991, abandoned, which is a continuation of application Ser. No. 07/406,814 filed Sep. 12, 1990, abandoned, which is a continuation of application Ser. No. 07/132,692 filed Dec. 14, 1987, abandoned, which is a continuation of application Ser. No. 07/009,108 filed Jan. 29, 1987, abandoned, which is a continuation of application Ser. No. 06/813,485 filed Dec. 26, 1985, abandoned.

BACKGROUND OF THE INVENTION

1. Field of the Invention

The present invention relates to a liquid-discharge recording apparatus and, more particularly, to a liquid-discharge recording apparatus having the mechanism to maintain a viscosity of an ink to be emitted so as to be fitted for emission at least when the ink is emitted.

2. Description of the Prior Art

According to liquid-discharge recording apparatuses, a recording liquid (for example, ink) is held in an ink vessel, the ink is led to a recording head unit from this ink vessel, a nozzle provided in the recording head unit is driven in response to a print pattern signal, and at the same time the ink is emitted from a discharge opening at the head of the nozzle, thereby performing the recording such as the printing or the like on a recording material such as a paper or the like. The ink emitted forms a jet liquid droplet and is deposited on the recording material.

As methods of emitting the ink onto the recording material, the method whereby an electromechanical converter such as, e.g., a piezoelectric device or the like is used, the method whereby an electrothermal energy converter is used, and the like are known. According to the method whereby the electrothermal energy converter is used, the ink in the nozzle is heated by the electrothermal energy converter to cause a change in pressure of the ink, thereby emitting the ink.

In the liquid-discharge recording apparatuses to which the above-mentioned emitting methods and other conventional emitting methods are applied, it is a general manner that the discharge opening at the head of the nozzle to emit the ink is always open into the open air irrespective of whether the apparatus is operating or not. Therefore, in the case where the recording is not performed for a long time, the water and volatile organic solvent or the like which are the components of the ink evaporate into the open air from the inks remaining at the discharge opening and in the portion near the discharge opening. Thus, the viscosity of the residual ink increases and exceeds a range of viscosity necessary for emission, causing a problem such that no ink is emitted in spite of the fact that a print signal is applied immediately after the apparatus operated and the recording was restarted.

In addition, there is also another problem such that a temperature of the ink decreases at low temperatures in winter season or the like, so that the viscosity of the ink also increases.

To solve the problem of the increase of the viscosity of the ink mentioned above, there has been proposed the method whereby the ink is heated just before the recording is restarted, namely, just before the ink is again emitted, and the temperature of the ink is increased, thereby reducing the viscosity and maintaining it to a predetermined viscosity range.

However, for such a preheating, the heating condition is largely changed due to the circumstances under which the recording apparatus is used. Namely, there is a drawback such that if the preheating condition is determined so as to obtain good emission of the ink droplets even under low temperature environment (for example, 5° C.), the viscosity of the ink becomes too low due to the heating under high temperature environment (e.g., 35° C.), so that the ink viscosity is out of the range necessary for good emission. On the contrary, in the case where the preheating condition is set so as to derive a good ink viscosity under high temperature environment, the necessary viscosity cannot be derived under low temperature environment.

Further, even when the environmental temperature is constant, the heating condition is also largely changed depending on the use state of the recording apparatus. Namely, due to the use of the recording apparatus, all of the thermal energy applied from the electrothermal energy converter to emit the ink droplets from the discharge opening, for example, is not necessarily used to form the ink droplets but a part of this thermal energy increases the temperature of the peripheral members of the electrothermal energy converter. Therefore, the temperature of the portion where the discharge opening is formed immediately after the completion of the recording is largely changed as compared with the temperature before the start of the recording, so that there is a problem such that, for instance, when the ink is heated at the restart of the recording just after the end of the recording, the ink is overheated and the viscosity overdecreases.

As another method for preventing the occurrence of the problem due to the increase of the viscosity of the ink, there has been proposed the method whereby the ink is always heated when the apparatus is used and the ink temperature is always kept constant in consideration of a change in temperature of the external environment and thereby to cope with the foregoing problem (Japanese Patent Unexamined Publication No. 187364/1983). As the ink heating means in this case, there are considered the method whereby the electrothermal energy converter which is used to form the flight ink droplets is used, and the method whereby another electrothermal energy converter is separately provided to always heat the ink.

However, the use of only the above methods also causes the problem such that it takes a time to heat the ink when the recording is restarted. Namely, in the case of using the electrothermal energy converter provided to form the ink droplets, it is possible to apply the electrical signal only within a range such as not to form any ink droplet. Therefore, an electrical signal of a high level cannot be applied and the heating time inevitably becomes long. In the case of using the electrothermal energy converter separately provided, such a limitation does not occur; however, since the heat is concentrated to only a single portion, the peripheral portion is influenced by the heat and the durability deteriorates. Thus, even in this case as well, an electrical signal of a fairly high level cannot be applied.

In addition to the foregoing heating methods, there has been further proposed the method whereby the recording head provided with the discharge opening in the recording apparatus is located at the home position when the recording is interrupted and this discharge opening is covered by a cap at the home position.

However, the use of both the heating of the ink and the capping of the discharge opening causes the viscosity of the ink to exceed the viscosity range necessary to emit the ink, so that the emission of the ink and the formation of the ink droplets are not always accurately performed. Further, in the case where the recording is interrupted for a long time, there is a risk such that the evaporation portion of the ink which is likely to be evaporated due to the heating of the ink leaks from the cap, so that the concentration of the ink near the discharge opening rather increases.

SUMMARY OF THE INVENTION

The present invention is made in consideration of the foregoing problems and it is an object of the invention to provide a liquid-discharge recording apparatus which can solve the conventional problems.

Another object of the invention is to provide a liquid-discharge recording apparatus in which the proper heating condition can be selected and the ink can be heated irrespective of the environmental condition under which the recording apparatus is used or the recording interruption or stop period of time before the recording is started.

Still another object of the invention is to provide a liquid-discharge recording apparatus in which the time of the preheating of the ink which is executed to obtain the viscosity range necessary to form ink droplets can be reduced and the peripheral parts are not thermally influenced.

Still another object of the invention is to provide a liquid-discharge recording apparatus having heating means for keeping the ink temperature constant, capping means for covering the discharge opening, and ink viscosity maintaining means which can maintain the viscosity of the ink to a value within the necessary range.

DETAILED DESCRIPTION OF THE PREFERRED EMBODIMENTS

In the case of the first embodiment of a liquid-discharge recording apparatus according to the present invention, a temperature sensor to detect a temperature of a recording head unit in which a discharge opening is formed is provided and the heating condition is selected on the basis of a detection signal of this temperature sensor.

An electrothermal energy converter for heating can also serve as an electrothermal energy converter for emission. Namely, in the recording apparatus of the type in which ink droplets are formed by heating and expanding the ink by the electrothermal energy converter for emission, two roles for emitting and heating can be achieved by changing a level of an electrical signal which is applied to the electrothermal energy converter. In this case, as compared with the case where another electrothermal energy converter for heating is separately provided, only the minimum portion which needs to be heated can be heated, so that the influence of the heat to the peripheral portion of the electrothermal energy converter can be suppressed to the minimum degree.

Various kinds of controlling methods can be considered with regard to how to control the electrothermal energy converter for heating in dependence on the temperature of the head unit detected by the temperature sensor. However, it is the most general method that the electrical signal for heating is applied to the electrothermal energy converter for heating until the temperature of the recording head unit near the nozzle becomes a predetermined temperature.

The heating is ordinarily performed immediately before the recording is started. It is desirable that the control of the electrothermal energy converter for heating is carried out by changing the level of the electrical signal in consideration of the recording interruption or stop period before the recording is started.

Figure 1:
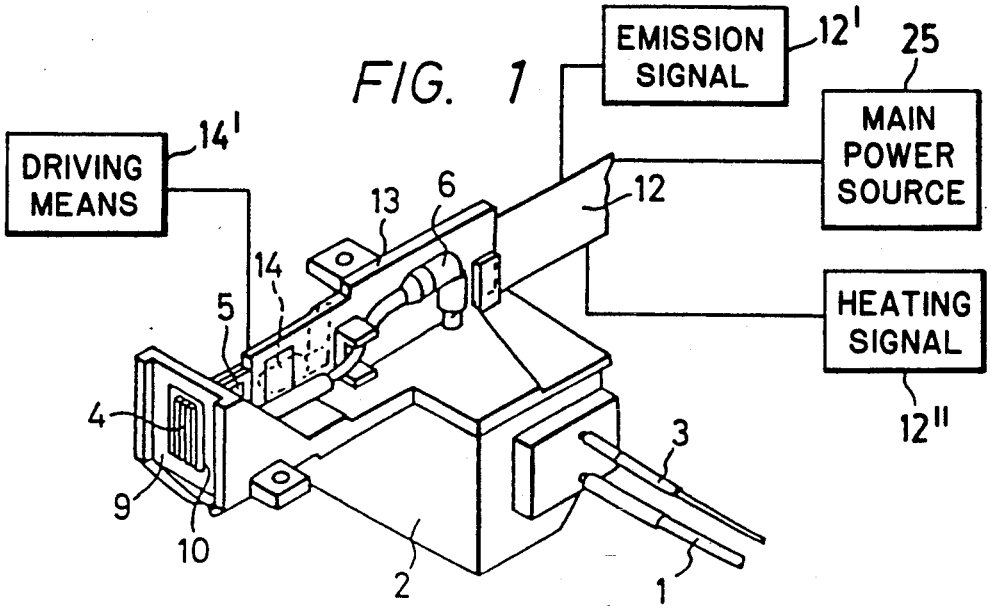
FIG. 1 is a schematic perspective view of a recording head unit of a liquid-discharge recording apparatus for explaining the first embodiment of the present invention.
Figure 2:
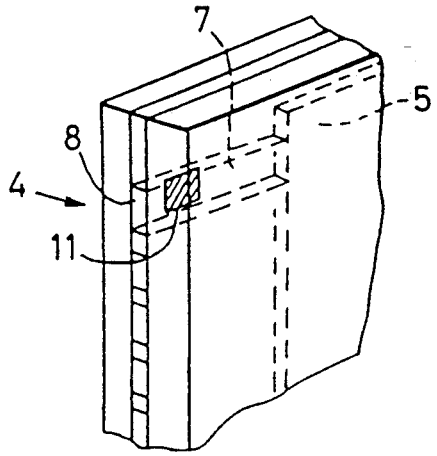
FIG. 2 is an enlarged diagram of a nozzle unit of FIG. 1.

The first embodiment of the invention will then be described hereinbelow with reference to FIGS. 1 to 3. FIG. 1 is a schematic perspective view of the recording head unit of the liquid-discharge recording apparatus according to the first embodiment. FIG. 2 is an enlarged diagram of the nozzle unit in FIG. 1.

In FIG. 1, an ink is led from a main tank (not shown) for storage of the ink to a sub-tank 2 for temporary storage of the ink by an ink supply tube 1. The ink a quality of which deteriorated and which could not be used is inhaled into a recovery pump (not shown) from the sub-tank 2 or the like through a suction tube 3. The sub-tank 2 is communicated with a liquid chamber 5 provided behind a nozzle unit 4 through an ink supply tube unit 6, thereby allowing the ink to be supplied and inhaled. In FIG. 2, twenty-four nozzles 7 are vertically arranged in front of the liquid chamber 5. The head of each of the nozzles 7 forms a discharge opening 8. The ink is emitted from the discharge opening 8 toward a recording material. Those plurality of nozzles 7 constitute the nozzle unit 4. The nozzle unit 4 is fixed to a bushing 10 located at the center of a front plate 9 arranged in front of the recording head. An electrothermal energy converter 11 for both emitting ink droplets and heating the ink is provided in each nozzle 7. Electrical signals are supplied to the converters 11 from a main power source 25 through an electrical wiring section 12. These electrical signals are generated by emission signal generating means 12' and heating signal generating means 12'' represented in FIG. 1. The wiring section 12 and supply tube unit 6 are together supported to a base plate 13. A temperature sensor 14 consisting of a thermistor is attached near the liquid chamber 5 provided for the base plate 13. Driving means 14', represented in FIG. 1, controls the heating signal generating means on the basis of the temperature information detected by the temperature sensor 14.

A control method of the liquid-discharge recording apparatus having the above-mentioned arrangement will then be explained with reference to FIG. 3. As described above, the electrothermal energy converter 11 is used for both emitting and heating. The heating of the ink is carried out in two kinds of heating modes; namely, the first heating mode in that the heating is performed at the restart of the recording after the stop of the recording when a power supply of the apparatus is OFF; and the second heating mode in that the heating is performed at the restart of the recording after the stop of the recording when the power supply of the apparatus is ON. In this example, the pre-ink-jet of ink droplets is also carried out prior to performing the actual printing. The applying levels of the foregoing first and second heating electrical signals and of the emitting electrical signal are shown in Table 1.

TABLE 1

| | Voltage (V) | Pulse width (μsec) | Frequency (kHz) | Applying time, the number of pulses, etc. |
|---|---|---|---|---|
| 1st heating electrical signal | 23.5 | 2 | 16 | Apply until the recording head temperature becomes 45° C. |
| 2nd heating electrical signal | 23.5 | 2 | 35 | Apply for one second |
| Emitting electrical signal | 23.5 | 10 | 2 | |
| 1st pre ink jet electrical signal | 23.5 | 10 | 2 | Apply 100 pulses |
| 2nd pre ink jet electrical signal | 23.5 | 10 | 2 | Apply 100 pulses |

TABLE 2

| (Compositions of the ink) | |
|---|---|
| C.I. direct black 19 | 2 weight parts |
| Diethylene glycol | 30 weight parts |
| Water | 70 weight parts |

Namely, after the recording was stopped in the OFF state of the power supply of the apparatus, when this power supply is turned on, the first heating is performed and the first heating electrical signal of a voltage 23.5 V, a pulse width 2 μsec, and a frequency 16 kHz is applied until the temperature of the recording head becomes 45° C. Thereafter, to perform the pre-ink-jet which is not used for printing, the first pre-ink-jet electrical signal of a voltage 23.5 V, a pulse width of 10 μsec, and a frequency 2 kHz is applied by 100 pulses. The apparatus waits for a printing signal after completion of the preliminary emission of the ink. When the printing signal is applied, if the temperature of the recording head exceeds 20° C., the second pre-ink-jet is carried out. This is because a consideration is made to the case where the recording interruption period after the end of the first pre-ink-jet becomes long. The second pre-ink-jet is performed by applying 100 pulses of the second pre-ink-jet electrical signal of a voltage 25.5 V, a pulse width 10 μsec, and a frequency 2 kHz. After completion of the second pre-ink-jet, the inherent emission of ink droplets is carried out and the recording is started. When the temperature of the recording head is below 20° C., the second heating is performed and the recording head temperature is controlled so as to become 20° C. or more. This second heating is executed by applying the second heating electrical signal of a voltage 23.5 V, a pulse width 2 μsec, and a frequency 35 kHz for one second.

To explain the effect of this embodiment, the inventors of this application have performed the experiments to compare the embodiment and Comparison Examples 1 and 2, which will be explained later.

Experimental conditions

The environmental condition under which the liquid-discharge recording apparatus is used was set to two kinds: one is the condition at 10° C. and 20% RH; and the other is the condition at 40° C. and 20% RH. The compositions of the ink used are shown in Table 2. The condition before the recording is restarted is set to three kinds: the first condition is that the recording was interrupted for five seconds when the power supply of the apparatus was ON; the second condition is that the recording was interrupted for one hour when the power supply of the apparatus was ON; and the third condition is that the recording was stopped for 72 hours when the power supply of the apparatus was OFF. The dimensions of each of the 24 discharge openings are 50×40 μm and the recording unit in which they are vertically arranged in a line at regular intervals of 0.141 mm was used. It has been confirmed that when the signal to emit the ink droplets was applied for five minutes just before the recording is interrupted or stopped, the ink droplets were accurately emitted.

Figure 3:
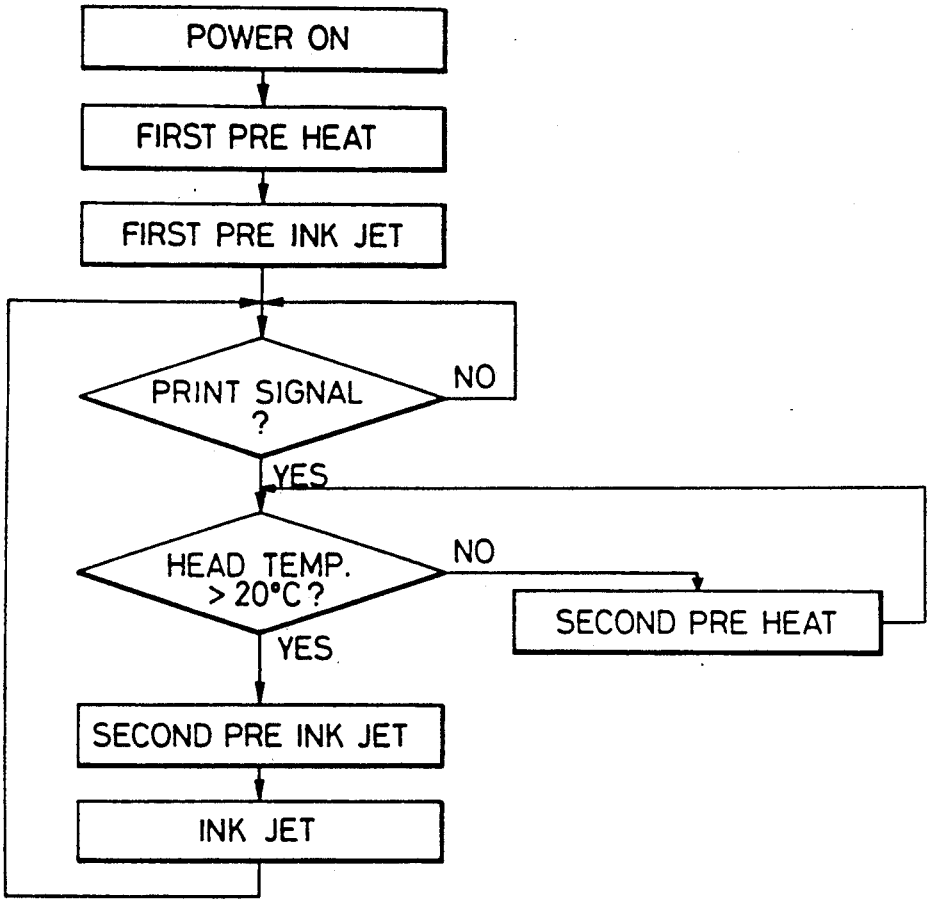
FIG. 3 is a flowchart showing the heating and pre-ink-jet controls in the apparatus of FIG. 1.

The control was performed in accordance with the flowchart of FIG. 3 as the experimental condition of the embodiment.

For Comparison Example 1, the recording was restarted without performing the first and second heating operations nor executing the first and second emitting operations.

For Comparison Example 2, in the case of restarting the recording in the recording stop state, the signal of the same voltage, pulse width, and frequency as those of the first heating electrical signal of the embodiment was heated for twenty seconds, and the same signals as the electrical signals for the pre-ink-jet of the embodiment were applied, and the heating and pre-ink-jet were carried out. In the case of restarting the recording in the recording interruption state, the electrical signal of the same voltage, pulse width, and frequency as those of the second heating electrical signal of the embodiment was applied for one second and the heating was performed.

The results of those three experiment examples are shown in Table 3 for comparison.

TABLE 3

| Recording interruption or stop period | Environment | Experiment 1 | Comparison Example 1 | Comparison Example 2 |
|---|---|---|---|---|
| | The number of ink droplets which are not emitted until the ink droplets are emitted from all of 24 discharge openings | | | |
| Recording interruption when the power supply of the recording apparatus is ON (5 seconds) | 10° C. 20% RH | ○ | ○ | ○ |
| | 40° C. 20% RH | ○ | ○ | No droplet is emitted from 5 discharge openings |
| Recording interruption when the power supply of the recording apparatus is ON (1 hour) | 10° C. 20% RH | ○ | 2,000 | ○ |
| | 40° C. 20% RH | ○ | ○ | ○ |
| Recording stop when the power supply of the recording apparatus is OFF (72 hours) | 10° C. 20% RH | ○ | No droplet is emitted from 3 discharge openings | ○ |
| | 40° C. 20% RH | ○ | ○ | No droplet is emitted from 5 discharge openings |

It has been found from the results of the experiments shown in Table 3 that the case of the embodiment of the invention in which the control was performed in accordance with the flowchart of FIG. 3 is superior to Comparison Examples 1 and 2.

Figure 4:
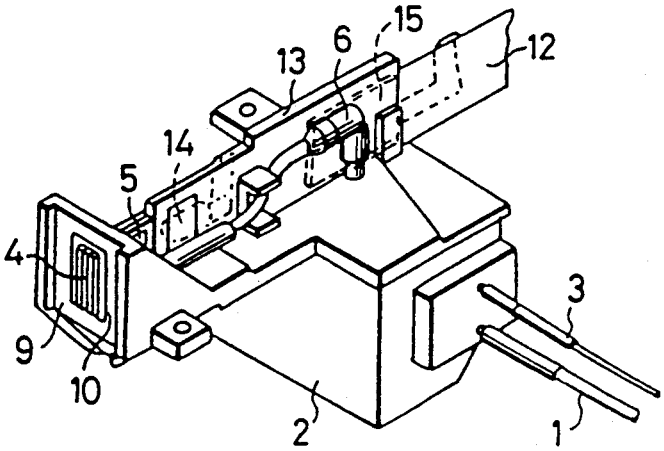
FIG. 4 is a schematic perspective view of a recording head unit for use in another example.

In the above embodiment, when the power supply of the apparatus is turned on in the recording stop state, the heating electrical signal is applied until the temperature of the recording head becomes a set value, and in the case where the recording is restarted in the recording interruption state, the content (voltage, pulse width, frequency, applying time) of the heating electrical signal is determined in accordance with the temperature of the recording head. Further, as a modified form of this embodiment, the recording stop or interruption period of the apparatus is counted and the supply of the heating electrical signal may be controlled on the basis of the count data of the recording stop or interruption period and the temperature data of the recording head. In addition, as shown in FIG. 4, the electrothermal energy converter for heating may be replaced by an external heater 15 which is separately provided.

In the case of the second embodiment of a liquid-discharge recording apparatus of the present invention, the foregoing object is accomplished by a constitution comprising: first heating signal generating means which has an electrothermal energy converter for heating a liquid to emit the liquid in response to the supply of an electrical signal and which generates an electrical signal which is applied within a range such as not to emit any liquid to the electrothermal energy converter; and second heating signal generating means for generating an electrical signal which is applied to an electrothermal energy converter provided to heat the liquid separately from the foregoing electrothermal energy converter, wherein the first and second heating signal generating means are constituted by the same means.

Namely, the electrothermal energy converter provided to form the ink droplets and the electrothermal energy converter separately provided to preheat are used to preheat the ink.

Figure 5:
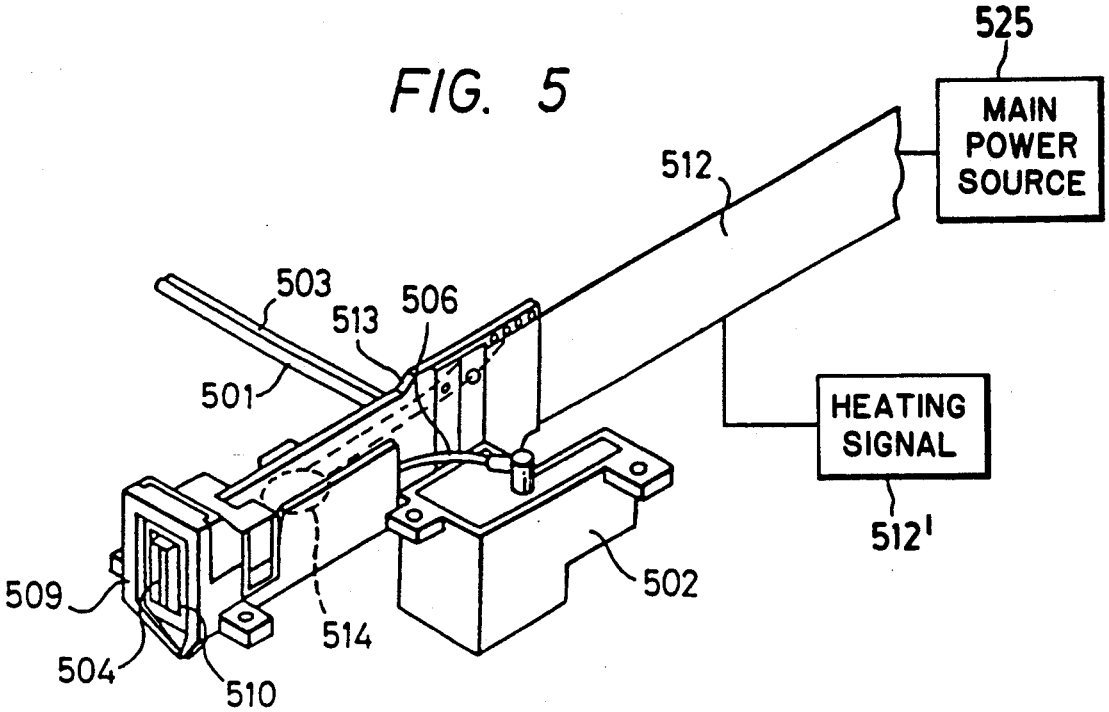
FIG. 5 is a schematic perspective view of a recording head unit in a liquid-discharge recording apparatus for use in the second embodiment.

The liquid-discharge recording apparatus according to the second embodiment of the invention will then be described with reference to FIGS. 5 and 6. FIG. 5 is a schematic perspective view of a recording head unit in the liquid-discharge recording apparatus and FIG. 6 is an enlarged diagram of a nozzle unit in FIG. 5.

In FIG. 5, the ink is led from a main tank (not shown) for storage of the ink to a sub-tank 502 for temporary storage of the ink through an ink supply tube 501. The ink a quality of which deteriorated and which could not be used is inhaled to a recovery pump (not shown) from the sub-tank 502 or the like through a suction tube 503. The sub-tank 502 is communicated with a liquid chamber 505 (see FIG. 6) arranged behind the nozzle unit 504 through an ink supply tube unit 506, thereby allowing the ink to be supplied and inhaled. In FIG. 6, a nozzle 507 is formed in front of the liquid chamber 505. For example, twenty-four nozzles 507 are vertically arranged. The head of each nozzle 507 forms an ink discharge opening, namely, an orifice 508. The ink is emitted toward a recording material from the orifice 508. Each nozzle 507 constitutes the nozzle unit 504. The nozzle unit 504 is fixed to a bushing 510 locating at the center of a front plate 509 arranged in front of the recording head.

An electrothermal energy converter 511 to emit the ink and form ink droplets is provided in each nozzle 507 and serves to emit the ink. Another electrothermal energy converter 514 is arranged near the liquid chamber 505. Electrical signals are supplied to the electrothermal energy converters 511 and 514 from a main power source 525 through an electrical wiring section 512. The electrical wiring section 512 and supply tube unit 506 are together supported by a base plate 513.

Figure 6:
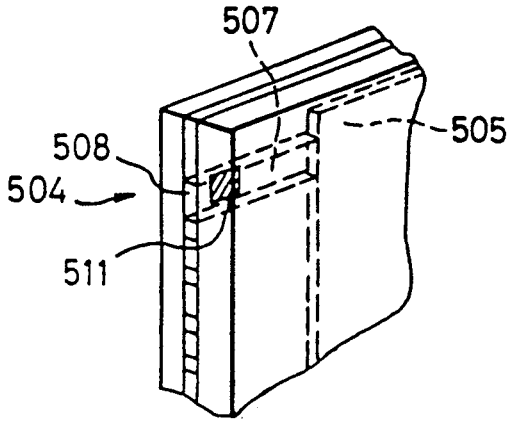
FIG. 6 is an enlarged perspective view of a nozzle unit in FIG. 5.

According to the liquid-discharge recording apparatus shown in FIGS. 5 and 6 described above, the electrothermal energy converter 511 provided to form the ink droplets and the electrothermal energy converter 514 provided separately to preheat are together used to preheat the ink. The use of both of those converters makes it possible to reduce the preheating time and to prevent the heat from being concentrated to a single portion, so that the bad influence on the peripheral parts can be prevented. On one hand, the electrical signal which is applied is determined in accordance with various conditions such as the applying condition of the ink-jet signal in the liquid-discharge recording apparatus, temperature characteristic of the ink which is used, particularly, the temperature characteristic of the viscosity of the ink, viscosity change characteristic of the ink in the recording interruption or stop state, and the like. For example, it is necessary to individually control the voltage, frequency, pulse width, and the like of the electrical signal to predetermined values and then apply the signal.

As the heating electrical signal generating means 512', as represented in FIG. 5 for applying the electrical signals to those two kinds of electrothermal energy converters 511 and 514, one electrical signal generating means is commonly used. The heating electrical signal to heat the electrothermal energy converter 511 to form the ink droplets and the heating electrical signal to heat (i.e., preheat) the electrothermal energy converter 514 within a range such as not to emit any ink droplet are together generated from the common heating electrical signal generating means.

Various kinds of timings to preheat the ink are considered. As one of them, the preheating signal may be applied immediately before the ink-jet signal is applied. On one hand, the preheating signal may be also always applied in the ON state of the power supply of the recording apparatus although no recording is performed (in the recording interruption state). Or, the preheating signal may be applied for a temporary period when the power supply is again turned on after the state whereby the power supply of the recording apparatus is OFF (after the recording stop state). Further, the recording interruption period is automatically counted in the recording interruption state and after an expiration of the recording interruption period longer than a predetermined time, the preheating signal may be also applied.

To which extent the ink is preheated, namely, to which degree the level of the preheating electrical signal is controlled differs depending on various conditions. Namely, various cases are considered in dependence on the characteristic of the recording apparatus, the physical property of the ink, and the environmental condition such as the temperature, humidity, and the like at the location where the recording apparatus is installed and used. The level of the preheating electrical signal may be properly determined in accordance with the respective conditions or the like.

Next, an explanation will be made with respect to the results of the comparison experiments in the cases where the recording is restarted after the ink was preheated according to the embodiment of the invention using the liquid-discharge recording apparatus shown in FIGS. 1 and 2 and where the recording is restarted without performing the preheating at all. As the ink used in the experiments, the ink of the compositions shown in Table 2 was used.

The dimensions of each of the 24 orifices (discharge openings) 507 are 50×40 μm. These orifices are vertically arranged in a line at regular intervals of 0.141 mm. The liquid-discharge (i.e., ink-jet) recording apparatus was used under the environment at 25° C. and 30% RH. The ink-jet recording apparatus was kept in the recording interruption state for one hour. In this example, the electrical signal to heat (preheat) the ink was sent to the electrothermal energy converter 511 to form the ink droplets (to emit the ink) during this interval and the heating electrical signal was also sent to the other electrothermal energy converter 514 which always operates within a range such as not to emit any ink. As the comparison example, the method whereby those preheating operations are not performed at all was used. Table 4 shows the voltages, pulse widths, and frequencies of those heating electrical signals and of the electrical signal to emit the ink (to form the ink droplets) to the electrothermal energy converter 511.

TABLE 4

| | Voltage (V) | Pulse width (μsec) | Frequency kHz |
|---|---|---|---|
| Ink-jet electrical signal to the converter 511 | 23.5 | 10 | 2 |
| Ink heating electrical signal to the converter 511 | 23.5 | 5 | 10 |
| Heating electrical signal to the converter 514 | 23.5 | | |

The results are as shown in Table 5.

TABLE 5

| | Recording interruption period | The number of ink droplets which are not emitted until the ink droplets are emitted from all of 24 orifices |
|---|---|---|
| The embodiment | One hour | 0 |
| Comparison example | One hour | 1000 |

In the case of the third embodiment of a liquid-discharge recording apparatus of the present invention, the viscosity of the ink is maintained by controlling the operation of heating means in response to the operation of capping means. Due to this, the unnecessary heating of the ink during the recording interruption period can be prevented and the viscosity range of the ink can be maintained to the necessary range.

The ink heating means mentioned above includes the means in which a heat generation level of an electrothermal energy converter (heating device) which is used to emit the ink and to form the ink droplets is reduced and this converter is used, the means in which a separate auxiliary heating device is used, and the means in which both of those electrothermal energy converter and auxiliary heating device are used. The capping means, on one hand, is not limited to the foregoing cap but an evaporating device containing an ink evaporation component may be positioned at a discharge opening.

An example of a structure of the liquid-discharge recording apparatus according to the third embodiment of the invention will then be explained with reference to FIGS. 7 and 8. The ink is supplied from a main tank (not shown) for storage of the ink to a sub-tank 702 for temporary storage of the ink through a supply tube arranged in a tube 701. A suction tube, which will be explained hereinafter, to inhale the choked ink from a discharge opening or the like is also arranged in the tube 701 and connected to a suction pump (not shown). The sub-tank 702 is communicated with a liquid chamber arranged behind a nozzle, which will be explained hereinafter, by a supply tube unit 703. A plurality of nozzles are vertically arranged in front of the liquid chamber. The heads of the nozzles are supported by a bushing 704 and open. The bushing 704 is fixed to a front plate 705 and constitutes a nozzle unit 706. An electrothermal energy converter 707 provided in the liquid chamber (not shown) is used to keep the temperature of the ink constant. Electrical signals to apply energies to the electrothermal energy converter 707 and to a heating device, provided in correspondence to each discharge opening, for emitting the ink and forming the ink droplets are supplied from a main power source 725 through an electrical wiring section 708 consisting of an FPC (flexible printed circuit). The electrical wiring section 708, supply tube unit 703, and nozzle unit 706 are supported by a base plate 709. The case plate 709 and sub-tank 702 and the like constitute a recording head unit as a whole. This recording head unit moves along a shaft 710 and performs the recording operation.

This recording head unit is returned to a predetermined home position when the recording is interrupted. The nozzle unit 706 is covered with a cap 712 having an interior portion 711 at the home position, thereby preventing the evaporation component of the ink from being evaporated from the head of the nozzle. No electrical signal is applied to the electrothermal energy converter 707 at the home position, so that the heating of the ink is stopped. Due to this, it is possible to prevent that the heating device 707 further operates in the state in that the cap 711 was coupled and the viscosity range of the ink exceeds the necessary range. It is further possible to prevent that the evaporation component of the ink which is heated and is likely to be evaporated leaks from the cap 711 when the recording is interrupted for a long time and the viscosity of the ink contrarily increases.

In the above example, another heating device 707 different from a heating device which is provided for a nozzle (not shown) and serves to form the ink droplets was used as the ink heating means. However, in this modified form, an electrical signal to this heating device is set to a low level and applied, thereby enabling the heating device to form the ink droplets to be also used as the heating means for keeping the ink temperature constant. On one hand, although the cap 711 was used as the capping means at the head of the nozzle in the foregoing example, in another modified form, further, an evaporating device containing an evaporation component of the ink may be allowed to exist in the cap 711 and may be also used as the capping means. In this case as well, it is possible to prevent that the ink evaporation component is evaporated at the home position when the recording is interrupted and the ink viscosity increases. Therefore, the further heating of the ink can be stopped, so that the viscosity range of the ink can optimized.

As the above-mentioned evaporating device, the ink droplets emitted from the discharge opening may be preliminarily emitted into an absorption material such as a sponge or the like and the ink may permeate this absorption material. In this case, it is preferable to perform the pre-ink-jet immediately after the recording head unit was returned to the home position.

The operation of the heating means for maintaining the ink temperature to a predetermined value as mentioned above is controlled by control means in response to the operation of the capping means.

Figure 7:
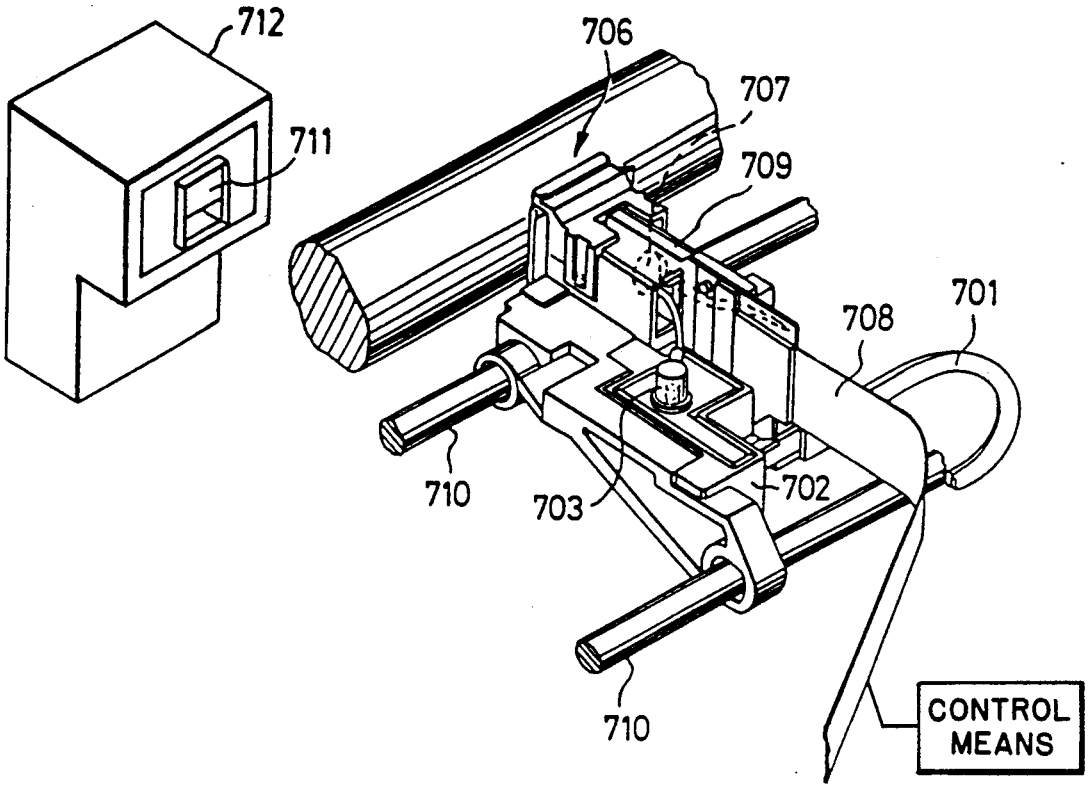
FIG. 7 is a rear perspective view of the main part of a liquid-discharge recording apparatus according to the third embodiment.
Figure 8:
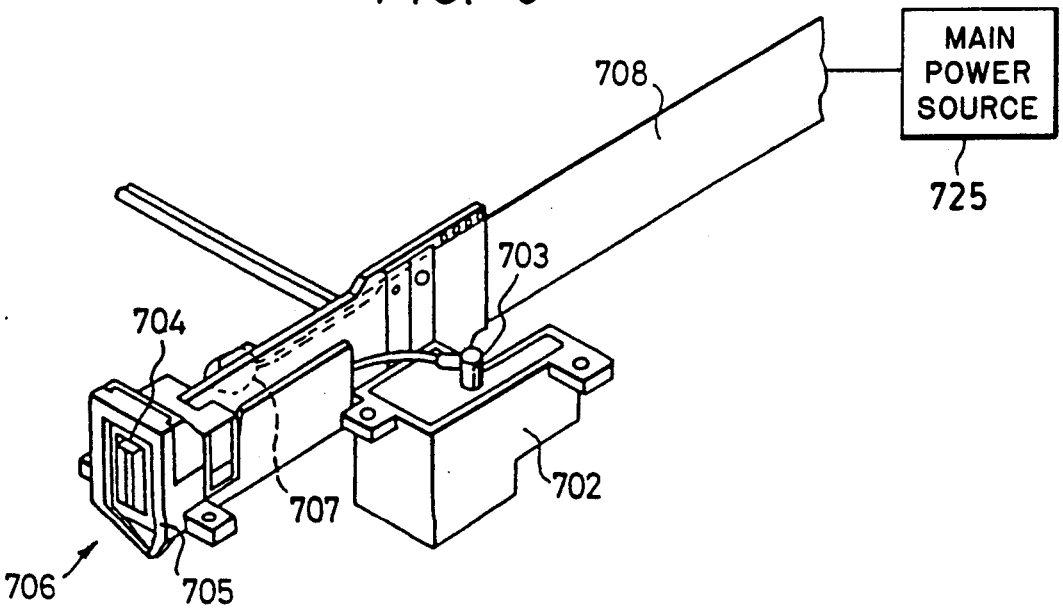
FIG. 8 is a front perspective view of a recording head unit in FIG. 7.

In this control means 712, represented in FIG. 7, the operation of the capping means is discriminated by, for example, an operation signal of the capping means or the ON/OFF of a switch which operates interlockingly with the movement of the capping means, or the like.

Figure 9:
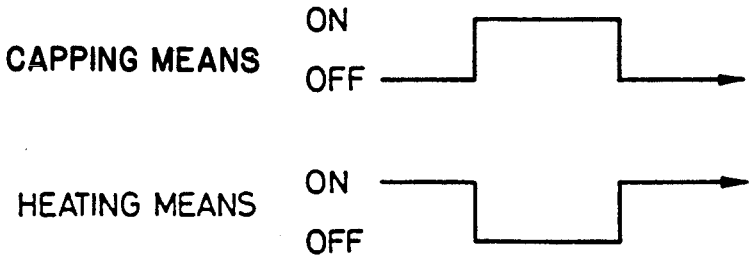
FIG. 9 is a timing chart showing examples of operation timings of capping means and heating means.

FIG. 9 is a timing chart showing an example of the operation timing between the capping means and the heating means. Under a fixed condition, it is possible to control in a manner such that the heating means is set to the inoperative mode (OFF state) when the capping means is operating (ON state) as shown in FIG. 9.

Figure 10:
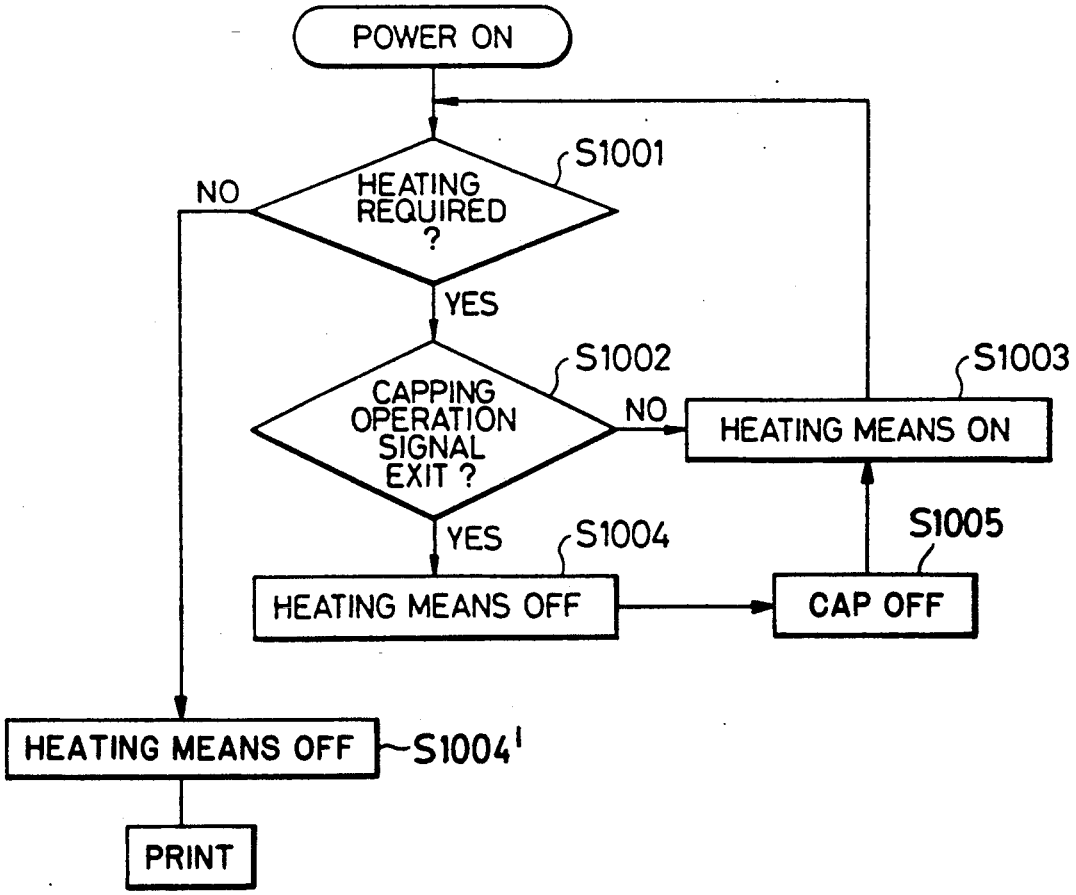
FIG. 10 is a flowchart showing an example of an operation procedure for controlling the operation of the heating means on the basis of the operation of the capping means.

FIG. 10 is a flowchart showing an example of an operation procedure of the control means in the case of controlling the heating means in response to the operation of the capping means as shown in the timing chart of FIG. 9.

In FIG. 10, when the power supply of the apparatus is turned on, in step S1001, the ink temperature is first detected by a temperature sensor attached to the recording head unit, or the like, and a check is made to see if it is necessary to heat the ink or not. If YES, the control means makes a check in step S1002 to see if the capping means is operating or not. If the capping means is in the inoperative mode and no operation signal is supplied, namely, if NO in step S1002, the heating means is turned on to heat the ink in step S1003. If YES in step S1002, the control means, while ensuring that the heating means is off in step S1004, releases capping in step S1005 before advancing to step S1003, since the control means prevents the cap from being "on" unless the heating means is "off" as illustrated in FIG. 9. When the heating means is ON, the operations in steps S1001 to S1003 are repeated and the heating operation is continued until the ink temperature reaches a predetermined value.

When it is determined that the ink temperature has increased and reached the temperature at which the heating is not required in step S1001, step S1004' follows irrespective of the presence and absence of the capping operation signal and the heating means is turned off to interrupt the heating. Of course, if the cap is "on" it must be removed prior to the initiation of recording, and this may occur before step 1004'. Then, the recording starts.

On one hand, even if the ink temperature does not increase to the predetermined value yet, when the capping operation signal exists in step S1002, namely, when the capping means is operating, step S1004 follows and the heating means is turned off to interrupt the heating prior to releasing the capping operation.

All of the above-described examples can be applied irrespective of the presence and absence of the sub-tank 2 or the presence and absence of the carriage, or the like.

According to the liquid-discharge recording apparatus of the present invention, the temperature of the recording head unit in which the ink discharge openings are formed is detected and the electrothermal energy converter for heating is controlled on the basis of this temperature. Therefore, the ink can be heated in consideration of the environmental condition under which the recording apparatus is used and of the recording interruption or stop period before the restart of the recording. In other words, since the operating environmental temperature and the recording interruption and stop periods are reflected in the temperature of the recording head unit, the optimum heating can be carried out by properly selecting the heating condition in accordance with the temperature of the recording head unit.

Further, according to the liquid-discharge recording apparatus of the invention, the preheating of the ink which is performed when the recording is restarted is carried out using both the electrothermal energy converter provided to form the ink droplets and the electrothermal energy converter separately provided to preheat the ink. Thus, the preheating time can be reduced and it is further prevented that the heat for preheating is concentrated to a single portion, so that the bad influence on the peripheral parts can be prevented.

In addition, according to the present invention, there is provided the control means for controlling the operation of the heating means for holding the ink temperature to a predetermined value on the basis of the operation of the capping means for covering the ink discharge opening. Therefore, it is possible to obtain the liquid-discharge recording apparatus which can automatically suppress that the ink viscosity changes to a value out of a desired viscosity range and can efficiently perform the recording with an excellent quality.

We claim:

1. A liquid-discharge recording apparatus comprising:

switching means for selectively supply power to said recording apparatus;

a recording head having a discharge opening for discharging liquid;

discharging means for discharging liquid from the discharge opening;

heating means for heating liquid in said recording head prior to recording;

capping means for covering the discharge opening; and control means for controlling said heating means including activating and deactivating said heating means so that the heating means is deactivated every time the capping means covers the discharge opening, even while said switching means supplies power to said recording apparatus.

2. A liquid-discharge recording apparatus according to claim 1, further comprising a subtank in fluid communication with said recording head.

3. A liquid-discharge recording apparatus according to claim 1, further comprising a plurality of discharge openings disposed in said recording head.

4. A temperature adjustment method applied in an ink jet record apparatus adapted for use with a power source for supplying power to the apparatus, the apparatus including a record head for emitting ink, temperature detection means provided on the record head for detecting the temperature of the ink, and heat means for heating the inks are provided, comprising the steps of:

applying, if the power source is turned on, a predetermined pulse signal to the heat means until a temperature of the ink reaches a first predetermined temperature;

detecting, if a record signal is input, the temperature by using the temperature detecting means; and applying, if the detected temperature is lower than a second predetermined temperature, which is lower than the first predetermined temperature, a pulse signal having a higher frequency than that of the predetermined pulse signal to the heat means to perform a heating.

5. A temperature adjustment method according to claim 4, wherein an electrothermal conversion element for emitting the inks is used as the heat means.

6. A liquid-discharge recording method applied in a liquid-discharge recording apparatus including a recording head having a discharge opening for discharging liquid, heating means provided for heating the liquid in the recording head, and capping means having an interior portion for covering the discharge opening, said method comprising the steps of:

supplying power to the recording apparatus;

discharging liquid from the discharge opening;

heating liquid in the recording head prior to recording;

covering the discharging opening with the capping means; and deactivating heating every time the capping means covers the discharge opening, even when power is supplied to the recording apparatus.

7. A liquid-discharge recording apparatus comprising:

switching means for selectively supplying power to said recording apparatus;

a recording head having a discharge opening for discharging liquid;

heating means for heating liquid in said recording head, said heating means comprising electrothermal energy converting means for generating energy in response to a discharge signal to discharge liquid and for generating energy in response to a heating signal to heat the liquid, without discharging;

capping means for covering the discharge opening; and control means for controlling said heating means by the heating signal such that said heating means is deactivated every time said capping means covers the discharge opening, even while said switching means supplies power to said recording apparatus.

8. A liquid-discharge recording apparatus according to claim 7, further comprising a subtank in fluid communication with said recording head.

9. A liquid-discharge recording apparatus according to claim 7, further comprising a plurality of discharge openings disposed in said recording head for emitting liquids.

10. A liquid-discharge recording method applied in a liquid-discharge recording apparatus including a recording head having a discharge opening for discharging liquid, heating means for heating the liquid in the recording head, and capping means having an interior portion for covering the discharge opening, said method comprising the steps of:

supplying power to the recording apparatus;

heating liquid in the recording head, said heating conducted by generating energy by electrothermal energy converting means in response to a discharge signal to discharge liquid and by generating energy in response to a heating signal to heat the liquid, without discharging;

covering the discharge opening with the capping means; and deactivating heating by the heating signal every time the capping means covers the discharge opening, even when power is supplied to the recording apparatus.

11. An ink heating method applied in an ink jet recording apparatus including an ink jet recording heat having an electro-thermal converter for generating thermal energy for heating and emitting ink and temperature detection means, wherein the ink is preheated by applying to the electrothermal converter a heating signal below a level which will cause ink emission, and the heating signal operates at one of a first heating signal level, and a second heating signal level different from the first heating signal level, said method comprising steps of:

responsive to electrically connecting the ink jet recording apparatus to a power source, applying the heating signal to said electro-thermal converter at the first level until the temperature of the recording head reaches a first predetermined temperature; and responsive to a decrease of the recording head temperature below a second predetermined temperature lower than the first predetermined temperature while said ink jet recording apparatus is electrically connected to said power source, applying the heating signal at the second level to said electro-thermal converter to conduct heating.

12. A method of claim 11, wherein the heating signal has a frequency at the first heating signal level lower than the frequency at the second heating signal level.

* * * * *

UNITED STATES PATENT AND TRADEMARK OFFICE

CERTIFICATE OF CORRECTION

PATENT NO. : 5,302,971 Page 1 of 2

DATED : April 12, 1994

INVENTOR(S) : Ohba, et al.

It is certified that error appears in the above-indentified patent and that said Letters Patent is hereby corrected as shown below:

Title page,
item [56] REFERENCES CITED - FOREIGN PATENT DOCUMENTS:

"54-246588 8/1979 Japan ." should be deleted;
"159465A 12/1985 United Kingdom" should read --2159465A 12/1985 United Kingdom--.

COLUMN 1:

Line 9, "continuation," should read --continuation--;
Line 12, "Sep. 12, 1990," should read --Sep. 12, 1989,--.

COLUMN 4:

Line 53, "ink" (third occurrence) should read --ink,--;
Line 55, "used" should read --used,--.

COLUMN 8:

Line 10, "ink" should read --ink,--;
Line 11, "used" should read --used,--;
Line 23, "locating" should read --located--;
Line 57, "FIG. 5" should read --FIG.5,--.

COLUMN 12:

Line 65, "supply" should read --supplying--.

UNITED STATES PATENT AND TRADEMARK OFFICE

CERTIFICATE OF CORRECTION

PATENT NO. : 5,302,971 Page 2 of 2

DATED : April 12, 1994

INVENTOR(S) : Ohba, et al.

It is certified that error appears in the above-indentified patent and that said Letters Patent is hereby corrected as shown below:

COLUMN 13:

Line 52, "discharging" should read --discharge--.

COLUMN 14:

Line 39, "heat" should read --head--;
Line 40, "electro-thermal" should read --electrothermal--;
Line 47, "comprising" should read --comprising the--;
Line 51, "electro-thermal" should read --electrothermal--;
Line 62, "tro-thermal" should read --trothermal--.

Signed and Sealed this

Thirteenth Day of December, 1994

Bruce Lehman

*Attest:*

BRUCE LEHMAN

*Attesting Officer*

*Commissioner of Patents and Trademarks*